US009633535B2

(12) United States Patent
Weinstein

(10) Patent No.: US 9,633,535 B2
(45) Date of Patent: Apr. 25, 2017

(54) METHOD AND SYSTEM FOR ADVANCED ELECTRONIC BORDER SECURITY

(71) Applicant: Sentrus International FZE, Dubai (AE)

(72) Inventor: Richard D. Weinstein, St. Louis, MO (US)

(73) Assignee: Sentrus International FZE, Dubai (AE)

( * ) Notice: Subject to any disclaimer, the term of this patent is extended or adjusted under 35 U.S.C. 154(b) by 18 days.

(21) Appl. No.: 14/423,344

(22) PCT Filed: Aug. 29, 2013

(86) PCT No.: PCT/US2013/057279
§ 371 (c)(1),
(2) Date: Feb. 23, 2015

(87) PCT Pub. No.: WO2014/077933
PCT Pub. Date: May 22, 2014

(65) Prior Publication Data

US 2015/0206403 A1 Jul. 23, 2015

Related U.S. Application Data

(60) Provisional application No. 61/694,853, filed on Aug. 30, 2012.

(51) Int. Cl.
*G08B 1/00* (2006.01)
*G08B 13/24* (2006.01)
*G08B 13/186* (2006.01)

(52) U.S. Cl.
CPC ..... *G08B 13/2497* (2013.01); *G08B 13/186* (2013.01)

(58) Field of Classification Search
CPC ..... G01M 11/3118; G01M 11/3172; G08B 13/186; G08B 13/2497; G08B 13/22;
(Continued)

(56) References Cited

U.S. PATENT DOCUMENTS 4,931,771 A 6/1990 Kahn
5,879,109 A * 3/1999 Finzel ..... E02F 5/12 138/105

(Continued)

FOREIGN PATENT DOCUMENTS

KR 10-0678685 B1 1/2007

OTHER PUBLICATIONS

International Search Report for PCT application PCT/US2013/057279 mailed Jun. 11, 2014.

(Continued)

*Primary Examiner* — Daniel Previl
(74) *Attorney, Agent, or Firm* — Polster, Lieder, Woodruff & Lucchesi, L.C.

(57) ABSTRACT

A system (10) for protecting a border (B) comprises a fiber-optic cable (12) extending from one end of a border to the other end thereof. The cable includes a bundle of optical fibers which connect to sensors placed at intervals long the border. Included within the fiber-optic cable is a high voltage conductor by which high voltage AC is introduced into, and passes through, the cable for powering the sensors. The high voltage is stepped down and rectified from AC to DC for this purpose. Various types of sensors (100-700) are arranged in pods (14) located at intervals along the length of the border. A method of border protection is also disclosed.

22 Claims, 3 Drawing Sheets

(58) Field of Classification Search
CPC G08B 13/10; G08B 13/1654; G08B 13/1672; G08B 13/183; G08B 13/19652; G08B 13/20; G08B 13/26; G08B 29/126; G01D 5/35383
USPC ..... 340/531, 555, 532, 533, 538.11, 538.12, 340/539.1, 539.11, 568.1, 636.15, 636.17, 340/649, 660, 662
See application file for complete search history.

(56) References Cited

U.S. PATENT DOCUMENTS

| | | | | |
|---|---|---|---|---|
| 6,816,073 | B2 | 11/2004 | Vaccaro et al. | |
| 6,934,426 | B2 | 8/2005 | Rich et al. | |
| 6,980,108 | B1 | 12/2005 | Gebbia et al. | |
| 7,142,736 | B2 | 11/2006 | Patel et al. | |
| 7,173,690 | B2 | 2/2007 | Haran | |
| 7,403,118 | B2 | 7/2008 | Belden, Jr. | |
| 7,659,817 | B2 | 2/2010 | Conti et al. | |
| 7,868,812 | B2 | 1/2011 | Huthoefer et al. | |
| 7,961,094 | B2 | 6/2011 | Breed | |
| 8,182,175 | B2 * | 5/2012 | Iffergan | B63G 13/00 405/104 |
| 2002/0130776 | A1 | 9/2002 | Houde | |
| 2005/0107968 | A1 | 5/2005 | Chun | |
| 2005/0276611 | A1 | 12/2005 | Patel et al. | |
| 2006/0044136 | A1 | 3/2006 | Kowal et al. | |
| 2007/0171400 | A1 * | 7/2007 | Payton | G01M 11/3172 356/73.1 |
| 2008/0250869 | A1 | 10/2008 | Breed et al. | |
| 2008/0266087 | A1 * | 10/2008 | Tatar | G08B 13/124 340/555 |
| 2009/0008619 | A1 | 1/2009 | Perry | |
| 2012/0169842 | A1 | 7/2012 | Chuang et al. | |
| 2012/0242788 | A1 | 9/2012 | Chuang et al. | |
| 2012/0317893 | A1 * | 12/2012 | Murphy | E04F 19/00 52/28 |

OTHER PUBLICATIONS

Written Opinion of the International Search Authority for PCT application PCT/US2013/057279 mailed Jun. 11, 2014.

* cited by examiner

METHOD AND SYSTEM FOR ADVANCED ELECTRONIC BORDER SECURITY

REFERENCE TO RELATED APPLICATIONS

This application is based upon and claims the benefit of U.S. provisional patent application 61/694,853 filed Aug. 30, 2012, and International Application PCT/US2013/057279 filed Aug. 29, 2013 and published under International Publication No. WO 2014/077933, by Richard D. Weinstein. for "A Method and System for Advanced Electronic Border Security", both of which are herein incorporated by reference.

STATEMENT REGARDING FEDERALLY SPONSORED RESEARCH OR DEVELOPMENT

N/A

BACKGROUND OF THE INVENTION

This invention relates to border protection between two countries or bounded areas; and, more particularly, to a method and system for advanced electronic border protection using a buried fiber-optic cable in which high voltage conductors are enclosed within the same cable sheath. This allows electrical power to be supplied throughout the length of the border without requiring power sources located at intermediate points along the length of the border.

One of the challenges in protecting borders is that borders usually involve long distances, covering a wide variety of terrains (flat, rolling, mountainous, sandy, packed earth, rocky, forested, water, swampy or marshy, etc.). Further, much, if not most, of a border usually stretches through remote and uninhabited areas. As a consequence, available electric utility service, installation of above ground monitoring equipment and underground sensors, system security, and the maintenance and repair of remote electric power generators to power the monitoring equipment and sensors, as well as ground radar, if it is employed, is scarce and cost prohibitive to install and maintain.

The method and system of the present invention utilizes a hybrid fiber-optic underground cable which includes a high voltage conductor which conducts electricity within the same cable sheath regardless of how the sheath is insulated. At each end of a border, high voltage power, for example, 13,300 VAC is introduced into the cable in parallel with the optical fibers making up the cable. This power is then tapped or utilized throughout the length of the cable to power remotely located sensors and monitoring equipment, transmit their output signals to one or more monitoring sites, and power auxiliary equipment installed along the run of the cable.

Remote surveillance systems are known in the art. See, for example, U.S. Pat. Nos. 7,051,356, and 8,319,833, both of which issued to the same inventor as the current application. However, these systems, while effective, are directed to surveillance and security at only one site rather than along the entire length of a boundary or border.

BRIEF SUMMARY OF THE INVENTION

The present disclosure is directed to a method and system for protection of a border usually extending a significant length.

As a system, the invention includes a fiber-optic cable system which extends from one end of a border to its other end regardless of the terrain through or under which the cable is routed. The cable, which runs underground the length of the border, comprises multiple sections each of which includes a bundle of optical fibers which are connected to sensors, monitors, transmitters and receivers, and auxiliary equipment located at intervals along the length of the border. Also included within the fiber-optic cable are high voltage conductors by which high voltage AC is introduced into, and passes through the cable. At selected points along the border where sensors are installed, strands of optical fibers are connected to the sensors for receiving outputs from the sensors and sending instructions to them. The sensors and other equipment are powered by the high voltage transmitted through the cable, this voltage being appropriately stepped-down and/or rectified from AC to DC so to power the sensors.

The sensors and monitors comprise a variety of each and are installed either individually or in packages (i.e., sensor pods) at pertinent locations along over the length of the border. The sensors and monitors are selected from a menu of such detectors or instruments with different sensors or monitors of a particular type being selected for each location depending upon the particular surveillance required at that location. The sensors used include multi-mode sensors, and sensors that not only detect the motion of humans but also that of animals, vehicles and other metallic and non-metallic objects, and the presence of nuclear, biological, and chemical (i.e., "NBC") materials.

The sensors may be located overtly (visible to the naked eye) or covertly (hidden). Spacing of the sensors is such that they overlap and there is no void in coverage of the border. In operation, the system captures and sends real time video and other information from any surveillance location along the length of the border to a monitoring site. If necessary, the information is encrypted or encoded in a secure format prior to transmission. Besides real time viewing of, or listening to, what is received, all the transmitted information is stored and archived for subsequent use.

The primary means of alerting security forces when an intrusion occurs is via fixed monitoring centers along the border or in other places. The system can optionally include radio frequency microwave with point-to-point (PTP) and point-to-multipoint (PTMP) communication capabilities, and can further incorporate a mesh topology for timely providing information to users. Real-time provision of sensor outputs to monitoring sites enables immediate assessments to be made as to the severity of an intrusion and the perceived threat it represents. Information derived from events occurring on the fiberoptic cable can be alternatively monitored via dissemination to ground vehicles, handheld display units, aircraft, and, via satellite and secure internet facilities to designated users.

As a method, the invention includes underground routing of a fiber-optic cable from one end of a border to the other end thereof. The cable includes a bundle of optical fibers which connect to sensors and other instruments located at intervals along the length of the border. The method further includes transmitting high voltage AC through the cable via high voltage conductors installed within the cable. Next, the method includes connecting strands of the optical fibers to the sensors and instruments and powering these devices using the high voltage transmitted through the cable. The voltage is appropriately stepped-down and rectified from AC to DC so to power the equipment.

The method and system provide a cost effective border protection system which is highly sensitive and reliable in detecting border incursions and reporting such incursions to a monitoring site or sites. As such, the need for installing and maintaining electrical generators and related equipment at sites intermediate the respective ends of the border is eliminated.

The system is relatively low maintenance because the number and location of power sources is substantially reduced with the power source being located at a readily accessible location for ease of maintenance and repair. Similarly, sensors and ancillary equipment is packaged for ease of service and or replacement to reduce any "down" time and insure border integrity throughout the length of the border.

The fiber optic cables used in the system have sufficient bandwidth to allow for a high level of monitoring using a wide range of sensors, for real-time data transmissions from a monitored site to a control center, as well transmission of control signals from the center to the site.

BRIEF DESCRIPTION OF THE DRAWING

In the drawings.

Corresponding reference characters indicate corresponding parts or features throughout the several views of the drawings.

DETAILED DESCRIPTION OF INVENTION

Figure 1:
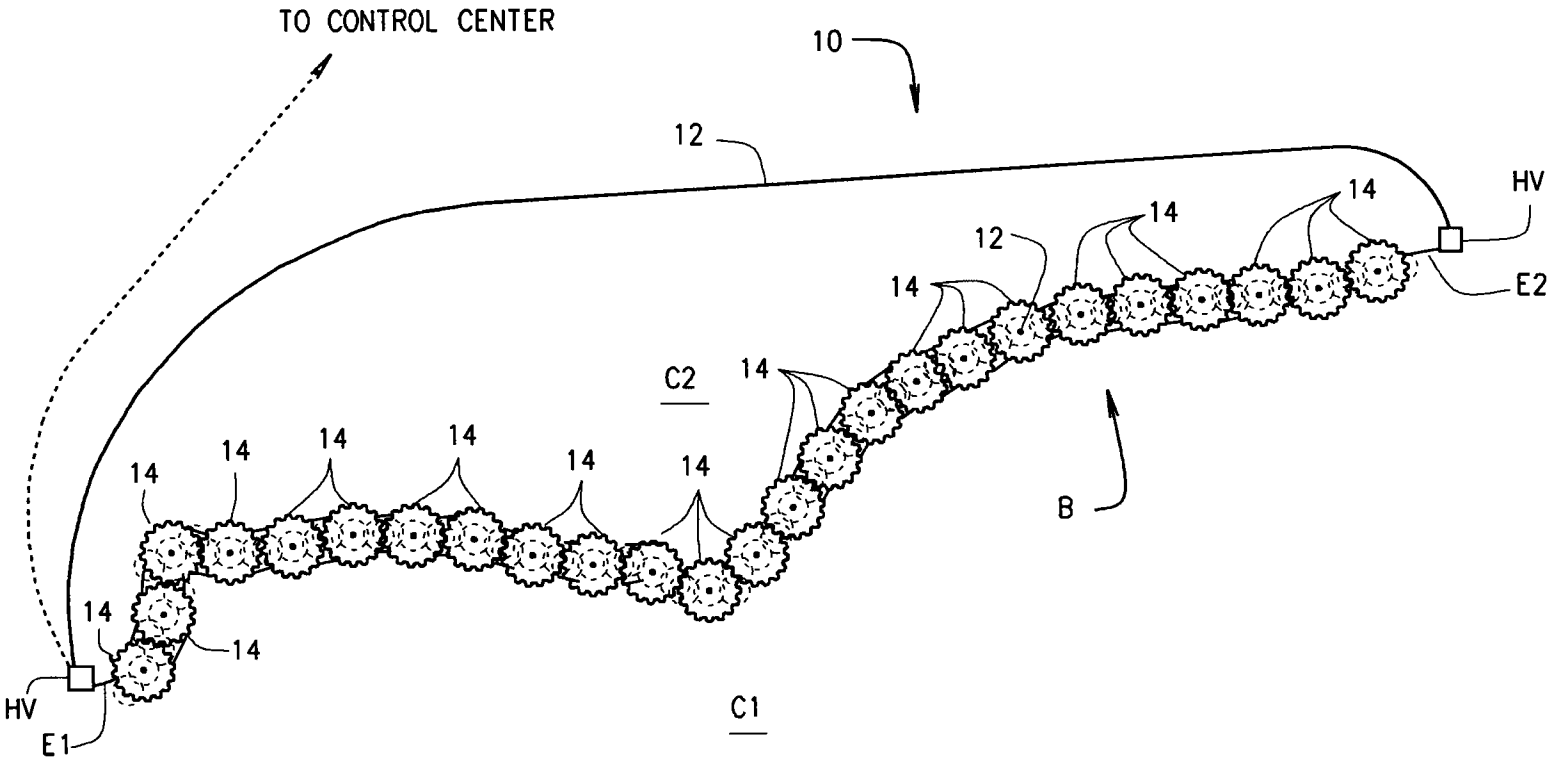
FIG. 1 depicts the installation of the high power fiber-optic border security system of the present invention along the border between two countries.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a border B extends between two countries C1 and C2. Although not shown in the drawings, border B typically extends over a variety of terrains and, in many instances, through remote, uninhabited areas. Heretofore, border protection systems have employed ground sensors including ground radar and the like to detect breaches of the border. The sensors were installed at intervals along the border and required locally available power for operation. As such, these systems required significant effort to remain in operation.

In accordance with the present invention, a border security system 10 includes a fiber-optic, high voltage (HV) cable indicated generally 12. Cable 12 is installed and extends along the entire length of border B. Importantly, the cable extends underground substantially the entire length of the border. At numerous sites along the border, sensors of various types, as described hereafter, are deployed. The sensors are used either individually, or they are incorporated into suites of sensors. Regardless, the sensors and their associated power and sensing lines are routed through a pod 14 which is installed at these locations. The various combination of sensors emplaced at a particular location are engineered to the particular terrain at the location as well as other variables unique to that particular stretch of border B such as the remoteness of the location, particular geographic features, the types of incursion activity experienced in the locale, etc. As shown in FIG. 1, the sensors and their associated pods 14 are installed so that their areas of coverage overlap. This spacing eliminates any areas which are void of sensor coverage. Accordingly, a continuous line of sensors is provided which provides an impenetrable line of coverage having no gap through which an intruder may sneak across the border, or an incursion occur, without it being detected. Those skilled in the art will understand, that while the spacing shown in the drawings indicates regular intervals, this is not necessarily so. Rather, in some areas the groups of sensors and their associated pods will be closer together than in other areas. The key is not one of spacing, but of complete coverage from one end E1 of border B to the other end E2 thereof.

Figure 3B:
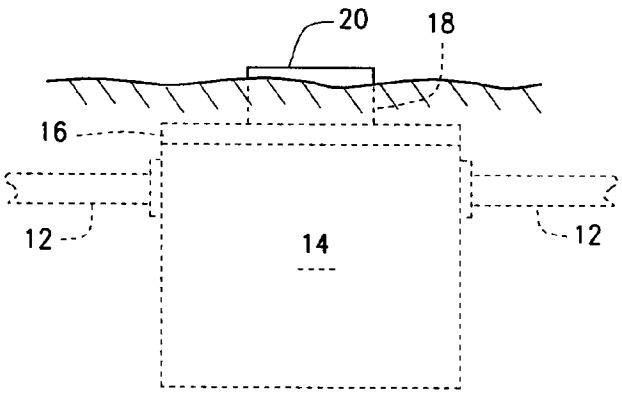
FIG. 3B is a installed view thereof.
Figure 3A:
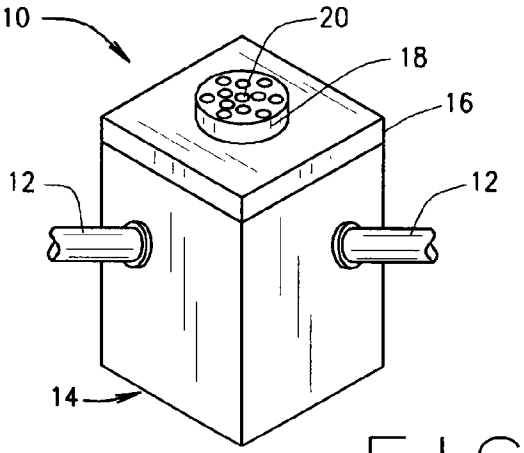
FIG. 3A is a perspective view of a representative vault for a sensor pod installed at the locations along the border.
Figure 4:
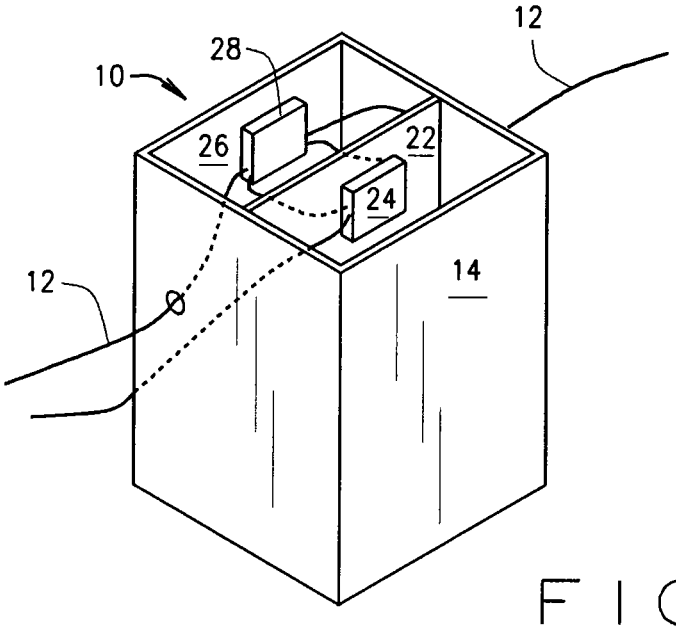
FIG. 4 is a perspective view of the vault.

As particularly shown in FIGS. 3A, 3B, and 4, pod 14 comprises a generally rectangular shaped container or vault having a removable lid 16. The pod is made of fiberglass, concrete, plastic, or other suitable material. The vault is designed to be buried underground at a convenient depth and is sealed and watertight when installed. Routing to and from pod 14 to its associated sensors is through an input/output port 18 projecting from the top of lid 16. As shown in FIG. 3B, when installed, an outer surface 20 of the port is generally flush with the surrounding surface.

Figure 2:
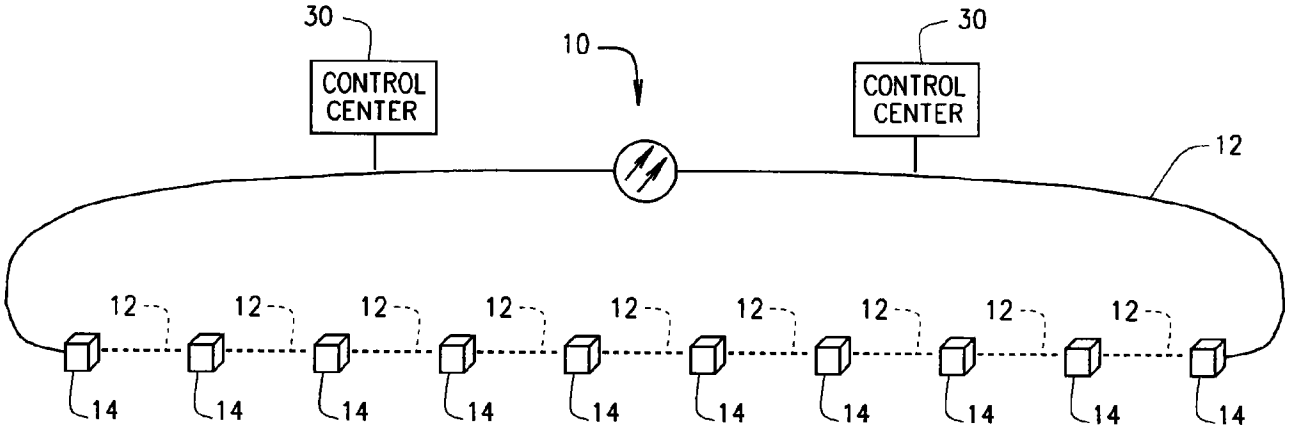
FIG. 2 is a view similar to FIG. 1 but illustrating the location of sensors along the length of the border.

A section of cable 12 extends between each pod 14 as shown in FIG. 2. Cable 12 includes a multitude of fiber-optic strands for connection to the various sensors deployed throughout system 10, via intermediate wiring connections as described hereafter. These connections allow information from the sensors to be conveyed along the cable for ultimate transmission to a control center, and for relaying commands/instructions from the control center to a sensor. In addition, high voltage cables are installed within the same cable sheath for routing high voltage along the entire length of cable 12. This voltage, which is, for example, 13,300 VAC is introduced into the cable at a location HV one of which is located at each end E1, E2 of border B. The high voltage electrical conductors within cable 12 extend the length of the cable. The high voltage generators may be available from electrical utilities located at or near each end of border B, or may be a separate non-commercial power generator. The transmission of 13,300 VAC through the conductors in cable 12 effectively eliminates the need for power generators previously required to be placed at intervals along the border in order to power sensors.

As shown in FIG. 4, pod 14 has both a high-power and a low-power section. Inside the pod are installed a series of boards 22. On one of the boards is installed one or more sensor interface units 24 for routing communications and transmissions to and from cable 12 to individual sensors. On another of the boards 26 is installed a power module 28. Module 28 includes step-down transformer and AC/DC rectifier circuits for transforming the high voltage routed through cable 12 to the voltages required by the respective sensors to operate. Voltage outputs from module 28 are routed through the units 24 for connection to the power inputs of the various sensors. Those skilled in the art will understand that the number of boards 22 or 26, interface units 24, and power modules 28 shown in FIG. 4 is representative only and that each pod 14 may include more of each depending upon the configuration of sensors used at the location where the pod is installed.

Figure 5:
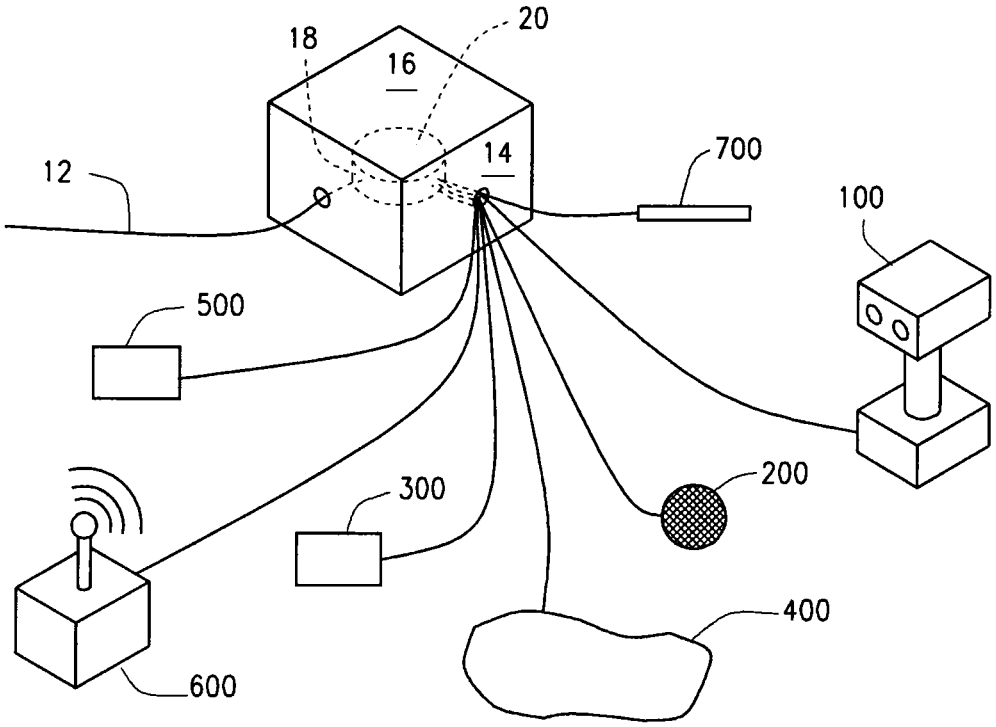
FIG. 5 is a simplified representation of sensors utilized at a sensor location.

To help protect the integrity of cable 12, it is deployed using self-healing rings (SHR) that require no power or access to the fiber strands. Accordingly, at the ends of the border, a dense wave division multiplexing solution is implemented which utilizes a high power laser (not shown) to repeat the signals to each end. Also, if necessary, the information provided by the sensors is encrypted or encoded in a secure format prior to transmission Referring to FIG. 5, the placement of sensors can be either covert or overt. If the placement is overt, the sensor, as installed, is readily visible (which in itself may act as a deterrent to crossing border B) or in a location which, even if not readily visible, can be seen if one is looking for it.

If the deployment is covert, then the sensor is housed in some type of concealment that shrouds its visibility. Various types of concealments are known in the art. See, for example, U.S. Pat. No. 8,314,839 also to the same inventor. An advantage of using concealed sensors is that it makes detection of intruders and anything they are bringing across the border with them easier (because they are not aware of its presence) and facilitate their apprehension. Those skilled in the art will appreciate that for covert placements, both the sensors and their concealments can be custom designed.

A first type of sensor used in system 10 includes optical and imagery sensors 100. Typically one or more of these type sensors are installed at each sensor location along the length of border B. The imaging sensors provide an all-weather means of detection of intruders or other objects entering their field-of-view (FOV). Many sensors further have a pan, tilt and zoom (PTZ) capability that enables them to track (either by manual control or automatically) any object surreptitiously crossing border B.

Cameras may be black-and-white or color cameras and are particularly useful in providing real time imagery or video used at a command site to view intruder(s). This lets security personnel perform a threat assessment as to whether or not the person(s) is friend or foe so to determine whether or not to send security forces to apprehend the individual(s). Other types of sensors employed include those using image intensification (e.g., infrared or thermal sensors). These extend viewing capabilities under less than advantageous lighting conditions. Furthermore, these other imagers can also be used in a fixed or variable mode of operation.

Importantly, a suite of imagery/optical sensors as employed in system 10 will all combine into one cohesive system. That is, when the presence of an intruder is sensed by any of the sensors, annunciation of the detection now allows security personnel to acquire and utilize imagery from the optical sensors to view an intruder and assess the threat he represents.

Next, the sensor suite also includes audio sensors 200. Many of these sensors include a filter capability to eliminate background noises so they can better detect pertinent sounds such as voices, vehicle sounds, etc., within the area where they are emplaced. Sounds picked up by the audio sensors are then analyzed to provide information as to movements, conversations and other noises which are evidentiary of intruders. The information they provide is also useful in aiding system operators to make threat assessments.

Vibration/seismic ground sensors 300 employed in system 10 incorporate accelerometers and other types of detection methods for sensing movements. It is important for these sensors to detect the minutest variations in the seismological signature of the ground at the location where they are installed. As such, the sensors are able to accurately detect footsteps, the movement of equipment, and other stimuli along a border area. Once positive detection of an intrusion is made, the outputs from these sensors are integrated into the detection scheme at that locale and reported back to the system operators. The operators again use these information in make a threat assessment and determining how to apprehend any intruders.

Weight/pressure sensors 400 are employed to detect the weight of persons, animals or vehicles, equipment or packages moving over border B within a monitored area. These sensors, for example, use underground switches either in the form of an individual pressure switch or an area switch via an underground mat. Once a sensor is activated, it communicates back to a system 10 command center.

Nuclear, biological, and chemical sensors 500, typically referred to as "NBC" sensors, include discrete or multiple detection sensors which detect through radiation or the air; the presence of nuclear materials, toxic chemicals typically utilized in weapons of mass destruction, and biological agents intended to harm or kill other human beings.

Two basic types of radar 600 are employed within system 10. The first type of radar is a ground based, threat detection radar which detects the movement of objects along the surface of the ground within the area where the radar is located along border B. The detectable object can be human or animal, metallic or other objects. Once an object is detected by ground radar it is located and tracked within the area using GPS.

The second type of radar is an airborne radar detection platform. These platforms are emplaced in sparsely populated, barren, and remote areas along the border. In operation they detect objects (airplanes) flying over the border. In many instances, the altitude and flight path of these objects make them undetectable by long range radar equipment.

Motion detection along border B can further be achieved using various models of coaxial and fiber-optic cable which detect above ground movement of people and equipment. Motion detection cables 700 of these types are usually buried underground and extend longitudinally along a strip of the border. Once detection occurs, specific GPS locations are coordinated and passed along the fiber-optic communications channel provided by system 10. If available, optical imagers, as described above, can be activated to perform a remote threat assessment as to friend or foe, or security personnel can be dispatched to the area for a similar purpose.

It is important to understand that at defined sensor locations, the sensors or sensor pods 14 are placed so that their field of or range of detection extends longitudinally along a strip of border B that is to be secured. Proper engineering and design of the required sensors to protect against all perceived threats will produce an end result of a secure area. The types and numbers of particular sensors used are based, to a large extent, on the topology and topography of each specific site where the sensors and sensor pods are located. In this regard, it is crucial to the reliable and continuous detection of intruders at any point along the border that the makeup of sensors, and the sensor pods and packages containing a suite of sensors be changeable from one location to another, as necessity dictates. Use of fiber-optic/HV cable 12 provides efficient access to bandwidth sufficient to interconnect all the sensors deployed along border B as well as the electrical power needed at each site along the border for the sensors to operate. This results in a cost effective, efficient solution to the challenge of implementing a comprehensive border security system.

Referring again to FIG. 2, the outputs from the various sensors routed through cable 12 are transmitted to one or more control centers 30 which are permanent, land based centers. In addition, information transmitted through cable 12 can also be transmitted to mobile/airborne control centers using a radio frequency ("RF") communications complement as indicated at 32.

In addition, to augment the monitoring resources provided by fiber-optic cable 12, certain border areas or regions may be further served by an extension of the communications path; this being accomplished using RF microwave communications equipment. The variations of RF network topology which can be utilized are configured using a set of back-to-back microwave radios arranged in a point-to-point, point-to-multipoint and mesh mode of operations. That is, it comprises a path which originates at point a Y and terminates only at a point Z.

Further in this regard is a mode of RF operation referred to as point-to-multipoint. Typically this arrangement involves a site having an omni-directional RF antenna capable of simultaneously transmitting RF microwave traffic to multiple remote sites. This configuration is optimal where multiple remote pods 14 are located such that they are within a line of sight path from a single host site.

In addition, system 10 can also be augmented using a mesh RF topology. In mesh topology, each site has the ability to operate as a repeater. This allows sites which do not have line of sight with a host site, but which do have line of sight with an intermediate site that does, to have RF signals transmitted from the host site repeated to them through the intermediate site.

Located at the control centers 30, or any mobile centers, are situational awareness displays for providing real-time information from the sensors and relevant situational aware data. These displays typically include aerial displays which are GPS coordinated with the location of each sensor pod 14 along the length of border B. Such displays, for example, are arranged as big screen wall displays for the overall system, as well as discrete computer graphical displays for each segment of the sensor network. The displays provide both access to alarm data and a video display based on inputs from the optical sensors deployed over the length of border B. When an incursion or intrusion event occurs, and a sensor or sensors are activated, the displays provide an annunciation to the system 10's operators in both sound and video. In many instances, the optical sensors integrated into system 10 allow operators to remotely assess an intruder and make a determination as to whether they are friend or foe. Such a decision can then result in security personnel being dispatched to the site of the incursion to intercept an intruder(s) if they are determined to be hostile.

Finally, each control center has the capability to store or archive received information from the sensors for future use.

In view of the above, it will be seen that the several objects and advantages of the present disclosure have been achieved and other advantageous results have been obtained.

The invention claimed is:

1. A system for protecting a border comprising:

a fiber-optic cable extending from one end of a border to the other end of the border regardless of the terrain encountered along the length of the border, the cable being installed beneath a surface of the ground substantially throughout the length of the border, and the cable including a bundle of optical fibers extending the length of the cable;

sensors installed at locations along the border for detecting an incursion or intrusion of the border, each sensor being connected to optical fibers of the cable; and, the cable further including a high voltage conductor also enclosed within the cable and extending throughout the length of the cable and by which high voltage AC is introduced into, and passes through the entire length of the cable for powering the sensors regardless of the sensor's location along the length of the cable, the provision of the high voltage conductor allowing power to be supplied to the sensors regardless of the sensors' location along the length of the cable and eliminating the need for other sources of power located anywhere along the length of the border; and, wherein the high voltage AC introduced into and passing through the fiber-optic cable is approximately 13,300 volts with the fiber-optic cable supplying all of the power required to power the sensors wherever the sensors are located along the length of the cable, and the fiber-optic cable further communicating outputs from each sensor, wherever located along the length of the cable, to a processing location where a sensor's output is evaluated and a threat assessment made with respect to a detected incursion.

2. The system of claim 1 in which a plurality of sensors are installed at each location, the sensors being comprised of different type sensors for detecting an incursion in different ways.

3. The system of claim 2 in which the different type sensors form suites of sensors arranged in sensor pods which are installed at the locations along the border.

4. The system of claim 3 in which each pod comprises a container placed in the ground and covered over so as not to be readily visible to someone attempting to cross the border.

5. The system of claim 4 in which the pods are connected together by segments of the cable with the cable supplying each pod a power and a communications capability for the sensors associated with that pod, and each pod including means for routing power to the sensors and for interfacing the sensors with the cable.

6. The system of claim 5 in which the means for power routing includes a step-down transformer and rectifier for converting the high voltage transmitted through the cable to a voltage required for powering each sensor associated with the pod.

7. The system of claim 2 in which the sensors can either be overtly or covertly installed at a location where they are installed.

8. The system of claim 3 in which the sensors include:

optical and imagery sensors;
audio sensors;
vibration/seismic ground sensors;
weight/pressure sensors;
NBC sensors;
radar; and
motion detection cables.

9. The system of claim 1 including at least one control center at the processing location to which sensor information transmitted through the cable is routed, the control center having means for displaying and evaluating the information received in order to make a threat assessment for a detected incursion.

10. The system of claim 9 further including additional means for routing information to the control center.

11. The system of claim 10 in which said additional means for routing information includes one or more of a point-to-point; point-to-multipoint; and mesh topology communications system.

12. The system of claim 9 further including a mobile control center and means for transmitting information routed through the cable to the mobile control center.

13. A method for protecting a border comprising:

installing a fiber-optic cable extending from one end of a border to the other end of the border;

installing the cable beneath a surface of the ground substantially throughout the length of the border and regardless of the terrain through which the cable is routed, the cable including a bundle of optical fibers extending the length of the cable;

installing sensors at selected locations along the length of the border to detect an incursion or intrusion of the border and connecting each sensor to optical fibers of the cable;

installing a high voltage conductor throughout the length of the cable for conduction approximately 13,300 volts AC from one end of the cable to the other end of the cable to conduct high voltage along the entire length of the border through the cable for powering the sensors regardless of a sensor's location along the length of the border, the provision of the high voltage conductor allowing power to be supplied throughout the length of the cable without the need for other sources of power located anywhere along the length of the border; and, communicating outputs from each sensor, wherever located along the length of the cable, to a processing location where the sensor output is evaluated and a threat assessment made with respect to the detected incursion.

14. The method of claim 13 in which a plurality of sensors are installed at each location, the sensors being comprised of different type sensors for detecting an incursion in different ways.

15. The method of claim 14 in which the sensors are either overtly or covertly installed at the location.

16. The method of claim 14 in which the different type sensors form suites of sensors arranged in sensor pods installed at the locations along the border, each pod comprising a container placed in the ground and covered over so as not to be readily visible to someone attempting to cross the border.

17. The method of claim 16 further including connecting the pods together by segments of the cable, the cable supplying each pod a power and a communications capability for the sensors associated with that pod, and each pod including means for routing power to the sensors and for interfacing the sensors with the cable.

18. The method of claim 17 in which the power routing means includes a step-down transformer and a rectifier for converting the high voltage transmitted through the cable to a voltage required for powering each sensor associated with the pod.

19. The method of claim 13 in which the sensors include:

optical and imagery sensors;

audio sensors;

vibration/seismic ground sensors;

weight/pressure sensors;

NBC sensors;

radar; and motion detection cables.

20. The method of claim 13 further including routing sensor information transmitted through the cable to a control center at the processing location having means for displaying and evaluating the information received in order to make a threat assessment for a detected incursion.

21. The method of claim 20 further including additionally routing information to the control center using one or more of a point-to-point; point-to-multipoint; and mesh topology communications system.

22. The method of claim 20 further including transmitting information routed through the cable to a mobile control center.

* * * * *